United States Patent [19]

Ohe et al.

[11] Patent Number: 4,717,921

[45] Date of Patent: Jan. 5, 1988

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 798,022

[22] Filed: Nov. 14, 1985

[30] Foreign Application Priority Data

Nov. 15, 1984 [JP] Japan ..... 59-242098
Dec. 7, 1984 [JP] Japan ..... 59-258949

[51] Int. Cl.[4] ..... H01Q 1/32; H01Q 7/08; H01Q 1/48; H01Q 1/40

[52] U.S. Cl. ..... 343/712; 343/713; 343/741; 343/788; 343/841; 343/866; 343/873

[58] Field of Search ..... 343/705, 708, 711–714, 343/726, 728, 741–744, 732, 748, 904, 905, 872, 709, 873, 702, 709, 710, 787, 841, 842, 866, 788, 867, 907, 908; 455/19, 41, 82, 99, 129, 269–280, 345

[56] References Cited

U.S. PATENT DOCUMENTS

| | | | |
|---|---|---|---|
| 2,200,574 | 5/1940 | McDonald, Jr. | 343/702 |
| 2,212,253 | 8/1940 | Stief | 343/715 |
| 2,404,093 | 7/1946 | Roberts | 343/708 |
| 2,474,794 | 6/1949 | Van Beuren | 333/81 A |
| 2,481,978 | 9/1949 | Clough | 343/712 |
| 2,520,984 | 1/1950 | Williams et al. | 343/712 |
| 2,520,986 | 9/1950 | Williams et al. | 343/867 X |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |

(List continued on next page.)

FOREIGN PATENT DOCUMENTS

| | | | |
|---|---|---|---|
| 0181765 | 5/1986 | European Pat. Off. . | |
| 0181200 | 5/1986 | European Pat. Off. . | |
| 0181120 | 5/1986 | European Pat. Off. . | |
| 0183523 | 6/1986 | European Pat. Off. . | |
| 889618 | 9/1953 | Fed. Rep. of Germany . | |
| 1131762 | 6/1962 | Fed. Rep. of Germany . | |
| 7015306 | 9/1970 | Fed. Rep. of Germany . | |
| 2425189 | 12/1974 | Fed. Rep. of Germany . | |
| 2701921 | 7/1978 | Fed. Rep. of Germany . | |
| 2745475 | 4/1979 | Fed. Rep. of Germany . | |
| 2821202 | 11/1979 | Fed. Rep. of Germany . | |
| 2733478 | 4/1980 | Fed. Rep. of Germany . | |
| 0046617 | 4/1980 | Japan | 343/712 |
| 5944861 | 3/1984 | Japan . | |
| 0129464 | 8/1985 | Japan . | |

OTHER PUBLICATIONS

Antenna System for Vehicle, Toyota Jidosha K.K. 6-9-85, Abstract of Japanese Document 60-172804(A); 1 page.

Japanese Pat. Abstract, vol. 6, No. 37 E-97, Mar. 6, 1982, 56-156031.

Japanese Pat. Abstract, vol. 6, No. 55 E-101, 4/10/82, 56-168441.

Japanese Pat. Abstract, vol. 7., No. E-187, 7/15/83, 58-70640.

Japanese Pat. Abstract, vol. 7., No. 162 E-187, 7/15/83, 58-70642.

*Primary Examiner*—Marvin L. Nussbaum
*Attorney, Agent, or Firm*—Cushman, Darby & Cushman

[57] ABSTRACT

The present invention provides an automobile antenna system including a small-sized loop antenna disposed in close proximity to the vehicle body and adapted to detect surface currents induced on the vehicle body by radio or other waves, the loop antenna being in the form of a single-winding coil which is housed within a casing rigidly mounted on the vehicle body near the marginal edge thereof, the casing being provided with an opening for receiving the marginal edge of the vehicle body such that the loop antenna can properly be positioned relative to the marginal edge of the vehicle body.

6 Claims, 18 Drawing Figures

U.S. PATENT DOCUMENTS

| | | | |
|---|---|---|---|
| 3,717,876 | 2/1973 | Volkers | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/744 X |
| 3,916,413 | 10/1975 | Davis | 343/712 |
| 3,961,292 | 6/1976 | Davis | 343/712 |
| 3,961,330 | 6/1976 | Davis | 343/412 |
| 3,972,048 | 7/1976 | Davis | 343/711 |
| 4,003,056 | 6/1977 | Davis | 343/713 X |
| 4,080,603 | 3/1978 | Moody | 343/712 |
| 4,217,591 | 8/1980 | Czerwinski | 343/713 |
| 4,260,989 | 4/1981 | Ishii et al. | 343/704 |
| 4,278,980 | 7/1981 | Ogita et al. | 343/748 |
| 4,317,121 | 2/1982 | Allen, Jr. et al. | 343/712 |
| 4,339,827 | 7/1982 | Torres et al. | 343/748 X |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |

AUTOMOBILE ANTENNA SYSTEM

BACKGROUND OF THE INVENTION

1. Field of the Invention

The present invention relates to an improved antenna system for an automobile, which can efficiently detect radio or other waves received by the vehicle body and then transmit the detected signals to various built-in receivers in the vehicle body.

2. Description of the Prior Art

Antenna systems are essential for modern automobiles to positively receive external waves such as radio waves, TV waves, car-telephone waves and others at built-in receivers in the vehicle bodies. Antenna systems also are very important for citizen band tranceivers which are used to effect the transmission and reception of waves between an automobile and other stations.

A pole type antenna is generally known which projects outwardly from the vehicle body. Although such a pole type antenna exhibits favorable reception performance, it always interferes with the design and aesthetics of the automobile.

Moreover, the pole type antenna is subject to being damaged or stolen and also produces an unpleasant noise when an automobile on which the pole antenna is mounted runs at high speeds. It was frequently desired to eliminate the pole type antenna from the vehicle body.

Recently, frequency bands of radio or other waves to be received at automobiles are being increased. Thus, an automobile requires a plurality of antennas for receiving radio or other waves belonging to various frequency bands. It is undesirable for the number of antennas to be increased, because this will severely damage the aesthetics of the automobile and provide electrical interference between the multiple antennas which degrades reception performance.

Some efforts have been made to eliminate or conceal the pole type antenna. One of these efforts is that an antenna wire is applied, for example, to the rear window glass of an automobile.

Another effort is that surface currents induced on the vehicle body by radio or other waves are detected. This appears to provide the most positive and efficient antenna means. However, experiments showed that such antenna means provided no expected results.

One of the reasons why surface currents induced on the vehicle body by radio or other waves could not efficiently be utilized is that the level of such surface currents is not as high as expected. The prior art mainly utilized surface currents induced on the roof panel of the vehicle body, notwithstanding, one could not obtain a sufficient level of detected signals to be utilized.

The second reason is that surface currents include a very large proportion of noise. Such noise mainly results from the operation of ignition and regulator systems in an engine and therefore cannot be eliminated unless the engine is de-energized.

Under such disadvantageous circumstances, some proposals have been made to overcome the above problems in the prior art. Japanese Patent Publication No. Sho 53-22418 discloses an automobile antenna system utilizing currents induced on the vehicle body by radio or other waves. This antenna system comprises electrical insulation formed on the vehicle body at a location in which induced currents flow concentrically. The antenna system also comprises a sensor for directly detecting currents between the opposite ends of the electrical insulation. It is true that the antenna system can detect practicable signals being superior in S/N ratio. However, this antenna system requires a pickup device which must be installed in a notch formed on the vehicle body. This is not suitable for use in mass-production.

Another proposal is disclosed in Japanese Utility Model Publication No. Sho 53-34826 in which a pickup coil is mounted on the vehicle body at one of its pillars so as to detect current is flowing on the pillar. However, the pickup coil must be mounted on the pillar perpendicular to its length. This is not practical and also appears to be merely theoretical, since the pickup coil can provide no practicable output.

SUMMARY OF THE INVENTION

It is therefore an object of the present invention to provide an antenna system for small-sized automobiles, which can efficiently detect currents induced on the vehicle body by radio or other waves and transmit the detected signals to built-in receiver means in the vehicle body and which can readily be mounted on the vehicle body.

To accomplish the above object, the present invention provides an automobile antenna system comprising a high-frequency pickup including a loop antenna positioned in close proximity to a marginal edge portion on the vehicle body such that the loop antenna can detect surface high-frequency currents having a frequency exceeding a predetermined level, the loop antenna being contained in and protected by a casing which is provided with an opening extending along the longitudinal portion of the loop antenna opposed to the marginal edge portion of the vehicle body, the forward portion of the opening being adapted to receive the marginal edge portion of the vehicle body such that the casing will properly be positioned relative to the vehicle body, and the rearward portion of the opening supporting one side of the loop antenna, whereby the loop antenna can properly be positioned relative to the marginal edge portion of the vehicle body.

From the background of the times, the prior art antenna systems were mainly intended to receive AM radio waves. Therefore, they could not efficiently receive AM radio waves since their wavelengths were too long. The inventors aimed at this dependency of frequency. The present invention is thus intended to receive radio or other waves belonging to FM frequency bands which are normally equal to or more than 50 MHz. As a result, the automobile antenna system according to the present invention can very efficiently receive radio or other waves from surface currents induced on the vehicle body.

Furthermore, the inventors aimed at the fact that the surface currents are distributed on the vehicle body at various different locations with various different levels. In accordance with the present invention, therefore, the high-frequency pickup is mounted on the vehicle body near a location in which the density of the surface currents is higher with less noise. In the present invention, one of the marginal edge portions of the vehicle body is selected as a location on the vehicle body which can meet the above desirable conditions.

In accordance with the present invention, moreover, the detection of source currents can efficiently be attained by the use of a loop antenna for electromagnetically detecting a magnetic flux formed by the surface currents induced on the vehicle body.

DETAILED DESCRIPTION OF PREFERRED EMBODIMENTS

First of all, a process of measuring the distribution of high-frequency currents on the vehicle body and determining a location at which an antenna system according to the present invention can most efficiently operate on the vehicle body will be described with reference to FIGS. 10 through 18.

Figure 10:
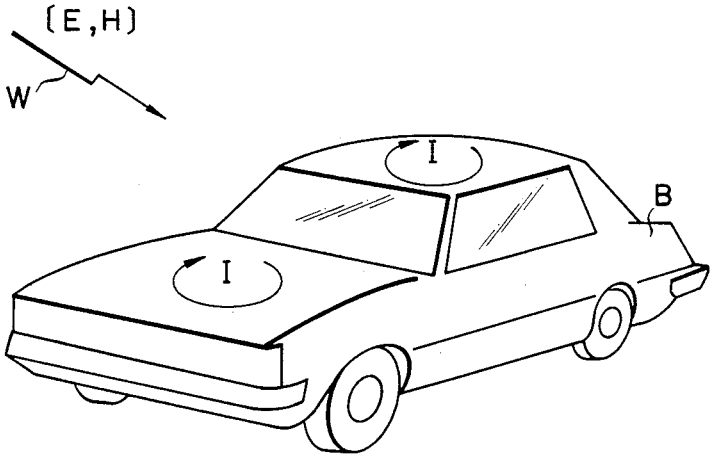
FIG. 10 illustrates surface currents I induced on a vehicle body B by external radio or other waves W.

FIG. 10 shows that when external waves W such as radio or other waves pass through the vehicle body B, made of an electrically conductive metal, surface currents I depending on the intensity of the external waves are induced on the vehicle body at various different locations. The present invention is intended to receive only external radio or other waves belonging to relatively high frequency bands equal to or more than 50 MHz. The present invention also is intended to measure the distribution of surface currents induced on the vehicle body by such external waves and determine a location on the vehicle body at which the density of the surface currents is higher with less noise, that is, a position in which the pickup is desirably located in accordance with the principle of the present invention.

The distribution of surface currents may be determined by a simulation of a computer and actual measurements of current intensity at various different locations on the vehicle body. To this end, a probe constructed and functioning in accordance with the same principle as that of the high-frequency pickup of the present invention is used such that it is moved over the entire surface of the vehicle body while angularly rotating at various different locations on the vehicle body.

Figure 11:
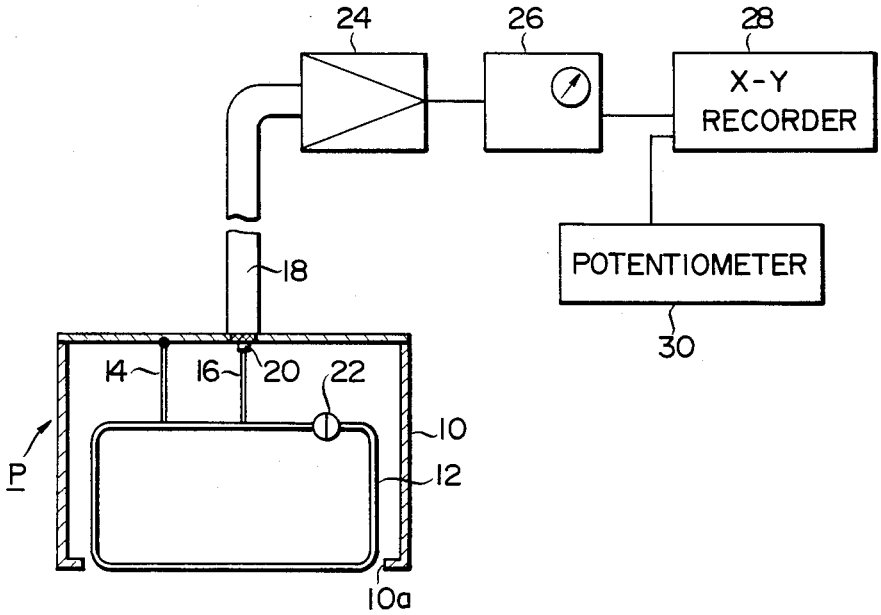
FIG. 11 is a block diagram of a probe and its processing circuit for determining a distribution of surface currents on the vehicle body, the probe being constructed and functioning in accordance with the same principle as that of the high-frequency pickup according to the present invention.

FIG. 11 shows such a probe P which comprises a casing 10, made of an electrically conductive material, and a loop coil 12 contained within the casing 10 and shielded by the casing 10. The casing 10 is provided with an opening 10a through which a portion of the loop antenna 12 is externally exposed. The exposed portion of the loop antenna 12 is positioned in close proximity to the surface of the vehicle body to detect magnetic flux formed by the surface currents on the vehicle body. The loop coil 12 is electrically connected with the casing 10 through a short-circuitng line 14. The output terminal 16 of the loop antenna 12 is electrically connected with a core conductor 20 in a coaxial cable 18. The loop antenna 12 includes a capacitor 22 connected in series therewith and which functions to cause the frequency of the loop antenna 12 to resonate with a desired frequency to be measured so that the efficiency of the pickup can be increased.

When the probe P is moved over the entire surface of the vehicle body B while angularly rotating at the respective points on the vehicle body, the distribution and orientation of surface currents on the vehicle body can accurately be determined As seen from FIG. 11, the output of the probe P is amplified by a high-frequency voltage amplifier 24 the output of which in turn is measured by a high-frequency measuring device 26 and also recorded by an X-Y recorder 29 as a value of the surface currents on the vehicle body at each of various different locations. The X-Y recorder 28 receives from a potentiometer 30 a signal indicative of each of the locations on the vehicle body. In such a manner, one can accurately determine values of surface currents corresponding to the respective locations on the vehicle body.

Figure 12:
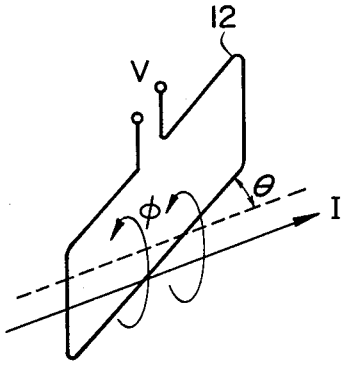
FIG. 12 illustrates an electromagnetic coupling between the surface currents I and the loop antenna of the pickup.
Figure 13:
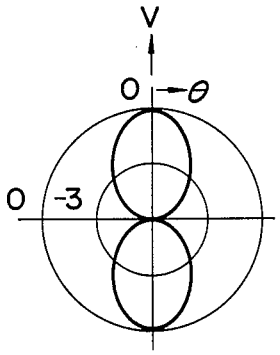
FIG. 13 illustrates the directional pattern in the loop antenna in FIG. 12.

FIG. 12 shows a deviation $\theta$ between the surface high-frequency currents I and the loop coil 12 of the probe. As shown in FIG. 12, a magnetic flux formed by the currents I intersects the loop coil 12 to create a voltage V to be detected in the loop coil 12. As seen from FIG. 13, the maximum voltage can be detected if the deviation $\theta$ becomes zero, that is, the loop antenna 12 is parallel to the orientation of the surface currents I. When the probe P is angularly rotated at each of the locations on the vehicle body to detect the maximum voltage, the orientation of the surface currents I can be determined.

Figure 14:
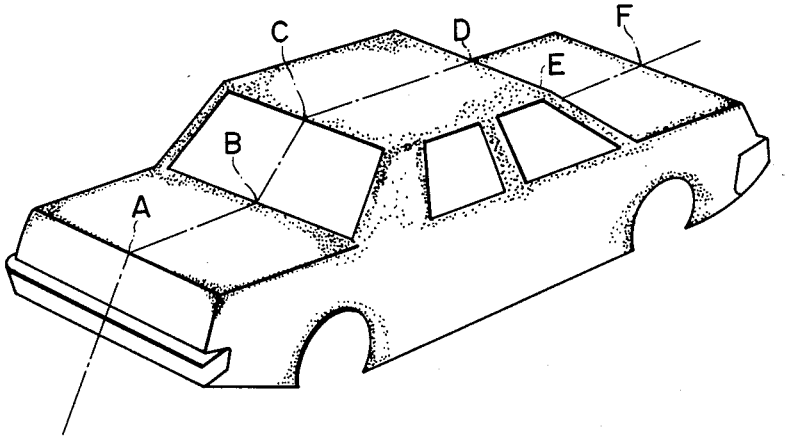
FIG. 14 illustrates the distribution of intensity in the surface currents induced on the vehicle body.
Figure 15:
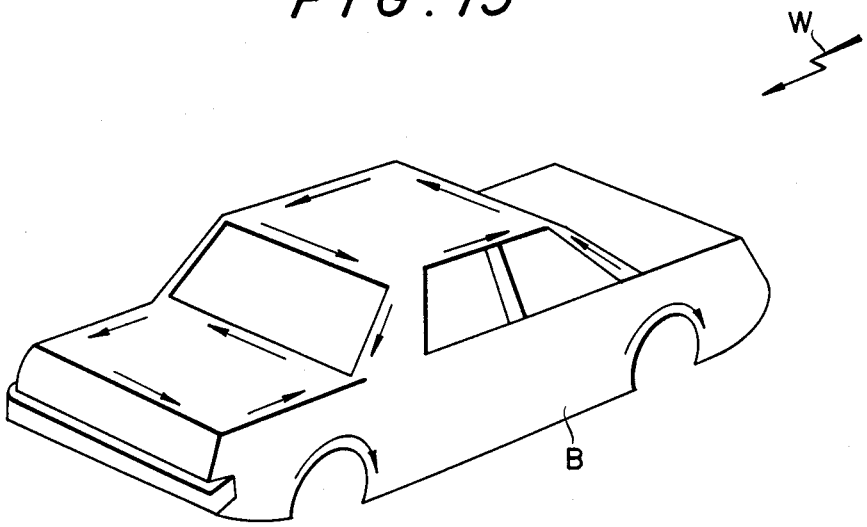
FIG. 15 illustrates the orientation of the surface currents induced on the vehicle body.

FIGS. 14 and 15 illustrate the distribution and orientation of surface high-frequency currents induced on the vehicle body at the respective locations and which have been determined by the simulation of the computer and the actual measurements of the probe P. As seen from FIG. 15, the density of the surface currents is higher along the marginal edge of a flat vehicle portion and then decreases toward the center of that flat vehicle portion. It is also understood from FIG. 15 that the surface currents flow concentrically parallel to each of the marginal edge portions of the vehicle body and along a connection between each adjacent vehicle portions of flat configuration.

Figure 17:
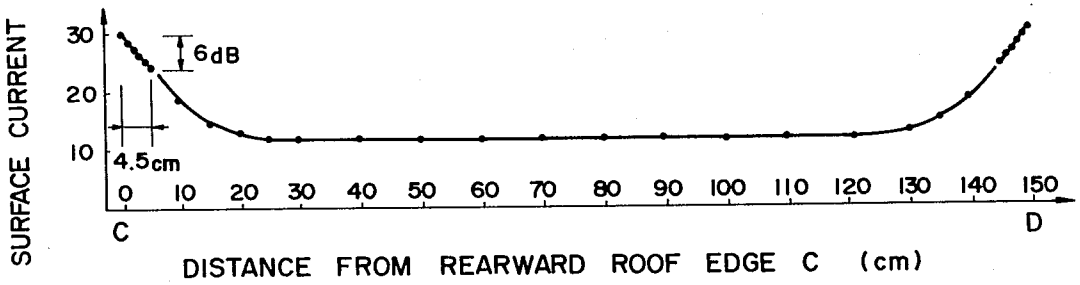
FIGS. 16, 17 and 18 are graphs each showing the distribution of surface currents along the longitudinal axis of the vehicle body shown in FIG. 14.
Figure 18:
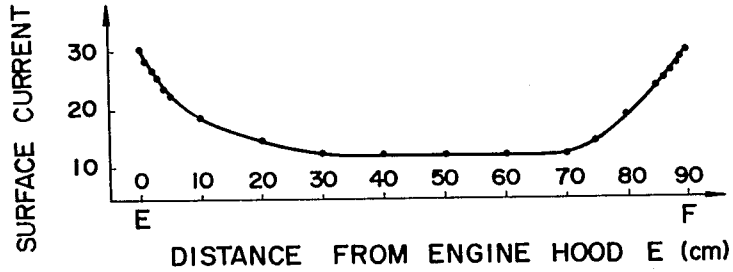
Figure 16:
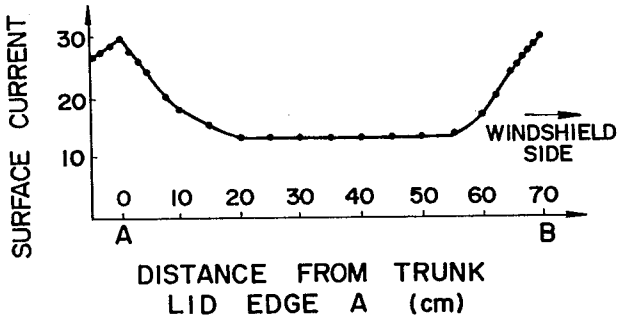

FIG. 16, 17 or 18 shows a distribution of currents induced on the vehicle body along each of sections on the longitudinal axis of the vehicle body as shown in FIG. 14.

FIG. 16 shows the distribution of surface currents induced on the trunk lid of the vehicle body along the axial section A-B. As seen from FIG. 16, the density of the surface currents is maximum at the opposite ends of the axial section A-B and then decreases toward the center thereof.

Accordingly, a high-frequency pickup is desirably located on one of the marginal edges of the trunk lid along its length to detect the surface currents flowing concentrically on the marginal edge of the trunk lid.

FIG. 17 shows the distribution of surface currents induced on the roof of the vehicle body while FIG. 18 shows the distribution of surface currents induced on the engine hood of the vehicle body. If a high-frequency pickup is located on one of the marginal edges of the roof and engine hood, the maximum currents can similarly be detected by the high-frequency pick-up. It is thus understood that radio or other waves can more sensitively be received by the pickup at the marginal edge of each of various different vehicle portions. It is of course also true that the high-frequency pickup may similarly be mounted on pillars and fenders of the vehicle body.

The high-frequency pickup is located in close proximity to the marginal edge of a vehicle portion on the vehicle body, for example, with its longitudinal portion extending parallel to that marginal edge. To obtain very excellent sensitivity, the high-frequency pickup is desirably spaced from the marginal edge of the vehicle portion inwardly within a certain range depending on the carrier frequency of radio or other waves to be received.

FIGS. 16 to 18 illustrate the distribution of surface currents induced on the vehicle body by FM radio waves having a frequency equal to 80 MHz. Considering the decrease of surface currents from a maximum to up to 6 dB in connection with the spacing between the marginal edge of the vehicle portion and the high-frequency pickup, it has been found that when the high-frequency pickup is spaced from the marginal edge of the vehicle portion within a distance a 4.5 cm, the antenna system may provide very excellent sensitivity.

This practicable spacing between the high-frequency pickup and the marginal edge of the vehicle portion depends on the level of the carrier frequency of the radio or other waves to be received. As the level of the carrier frequency increases, the spacing decreases.

It can be thus said that the practicable spacing between the high-frequency pickup and the marginal edge of the vehicle portion is inversely porportional to the carrier frequency of the radio or other waves to be received. Therefore, the high-frequency pickup according to the present invention should be spaced inwardly from the marginal edge of one of the vehicle portions within a range determined by the following formula:

$$12\times10^{-3}\ c/f\ \text{(meter)}$$

where c is the velocity of light and f is the carrier frequency. Thus, the sensitivity of the antenna system may be improved for each of the carrier frequencies of the radio or other waves to be received.

In such a manner, the high-frequency pickup according to the present invention can efficiently receive radio or other waves when it is located on the vehicle body in close proximity to the marginal edge of one of the vehicle portions, but spaced from that marginal edge within said range.

For a carrier frequency equal to 100 MHz, the high-frequency pickup may be spaced from the marginal edge of the vehicle portion within a distance of 3.6 cm. As the carrier frequency f increases, the high-frequency pickup will be located on the vehicle body nearer the marginal edge of the vehicle portion.

Figure 1:
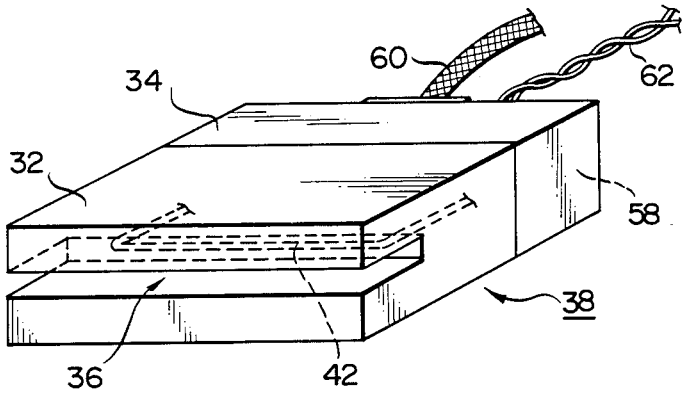
FIG. 1 is a perspective view of a high-frequency pickup used in an automobile antenna system according to the present invention.
Figure 2:
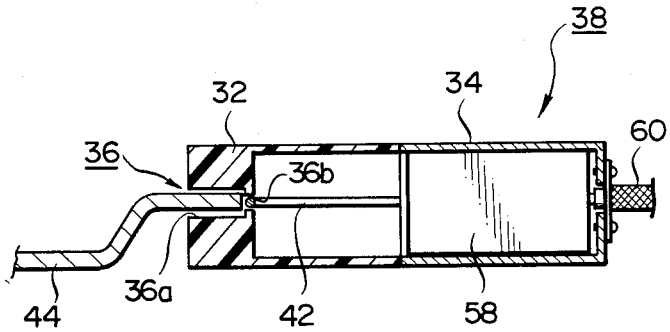
FIG. 2 is a cross-sectional view taken along a line II—II in FIG. 1.

Referring to FIGS. 1 and 2, there is shown a high-frequency pickup 38 comprising an antenna casing 32 in which a loop antenna 42 is housed for detecting surface high-frequency currents on the vehicle body. The high-frequency pickup 38 also comprises a circuit casing 34 which contains circuitry 58 for matching and amplifying signals, the circuitry being electrically connected with the loop antenna 32. Thus, the high-frequency pickup 38 is of an electromagnetic coupling type which is disposed in close proximity to the marginal edge of one of the vehicle portions.

Signals processed by the circuitry 58 are externally obtained through a coaxial cable 60 and then further processed by a circuit similar to that used in determining the distribution of surface currents. The circuitry 58 is supplied with power and control signals through a cable 62.

The loop antenna 42 is in the form of a single-winding coil which is covered with a suitable insulating material such that the coil can be electrically insulated from and disposed in close proximity to the marginal edge of the vehicle portion. Accordingly, a magnetic flux formed by the surface currents on the vehicle body can more effectively intersect the loop antenna 42.

In the embodiment of FIGS. 1 and 2, the antenna casing 32 is made of any suitable synthetic resin and thus protects the loop antenna 42 from any external impact or force. The circuit casing 34 is made of a metal plate and rigidly connected with the antenna casing 32. The synthetic resin casing 32 makes it possible that a magnetic flux formed on the marginal edge of the vehicle portion can be detected through an increased range. The metal casing 34 is electrically connected with the shield layer of the coaxial cable 60 to provide a wall structure for shielding any static electricity. Thus, circuitry 58 can be protected by the metal casing 34 from the influence of noise.

The portion of the antenna casing 32 to be opposed to the marginal edge of a vehicle portion on which the antenna system according to the present invention is to be mounted is provided with an opening 36 extending along the longitudinal portion of the loop antenna 42 which is housed within this antenna casing 32. The opening 36 serves as means for guiding and positioning the high-frequency pickup 38 relative to the marginal edge of the vehicle portion. The bottom edge of the opening 36 supports one side of the loop antenna 42.

More particularly, as shown in FIG. 2, the antenna casing 32 includes a forward thick-walled end portion to be opposed to the marginal edge of a vehicle portion on which the antenna system of the present invention is to be mounted. This forward thick-walled end portion of the casing 32 is formed with a first opening **36*a* which is of a rectangular shape extending parallel to the longitudinal portion of the loop antenna 42 in the casing 32. The bottom of the first opening 36a is provided with a second opening 36b through which the longitudinal side of the loop antenna 42 is exposed externally, that is, into the first opening 36a**.

These first and second openings 36a and 36b communicating with each other serve as means for properly positioning the loop antenna 42 and the marginal edge of the vehicle portion, respectively.

More particularly, when the loop antenna 42 of the high-frequency pickup 38 is housed within the casing 32, the detecting side of the loop antenna 42 is inserted into and positioned in the second opening 36b of the casing 32. The second opening 36b of the casing 32 has a width substantially equal to the diameter of the loop antenna 42. Therefore, the detecting side of the loop antenna 42 can firmly be held in the second opening 36b. As a result, any undesirable vibration can effectively be avoided at the loop antenna 42 even when the vehicle runs.

The high-frequency pickup 38 is mounted on the vehicle body in a place such that the opening 36a of the casing 32 commnicating with the second opening 36b thereof receives the marginal edge of an inner panel member 44 of the vehicle body. In this manner, the loop antenna 42 can properly be positioned relative to the marginal edge of the inner panel 44 of the vehicle body.

The high-frequency pickup 38 thus positioned can then be connected rigidly with the vehicle body by adjustable mounting bracket means (not shown).

Since the high-frequency pickup 38 can properly be positioned on the vehicle body by the use of the opening 36 in the casing 32 such that the loop antenna 42 therein will be disposed in close proximity to the inner panel member 44 of the vehicle body, the high-frequency pickup 38 can readily be mounted on the vehicle body. Furthermore, surface high-frequency currents induced on the vehicle body by radio or other waves can efficiently be detected by the high-frequency pickup 38 since the loop antenna can be disposed as near the marginal edge of the vehicle body as possible.

Figure 3:
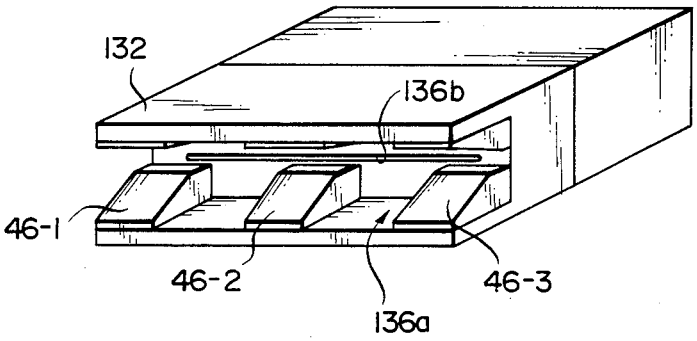
FIG. 3 is a perspective view of another form of a high-frequency pickup according to the present invention.
Figure 4:
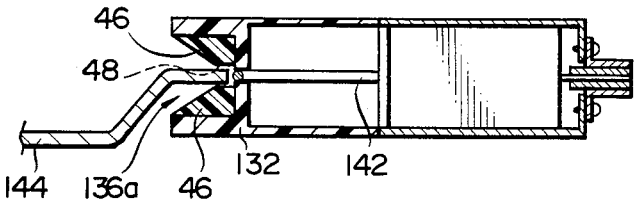
FIG. 4 is a cross-sectional view taken along a line IV—IV in FIG. 3.

Referring next to FIGS. 3 and 4, there is shown another embodiment of a high-frequency pickup according to the present invention in which parts similar to those of the previously described embodiment are denoted by similar reference numerals added by one hundred. The embodiment shown in FIGS. 3 and 4 can accommodate various vehicle members different from each other in thickness.

A casing 132 has a first opening 136a of rectangular cross-section which is formed in the forward end of the casing 132. The first opening 136a has upper and lower walls on each of which a plurality of guide elements 46-1, 46-2 and 46-3 are removably mounted and spaced from one another along the length of the upper or lower wall. The guide elements 46 on the upper wall of the opening 136a are positioned respectively relative to those on the lower wall of the same to define guide groove means 48 for properly positioning the marginal edge of the inner panel member 144 relative to a loop antenna 142 housed within the casing 132. The guide elements 46 in the opening 136a may readily be replaced by other guide elements each having a different size to define guide groove means for receiving the marginal edge of another inner panel member 144 having a different thickness.

The guide elements 46 may be made of the same material as in the casing 132 to reduce the entire weight of the casing 132.

Figure 5:
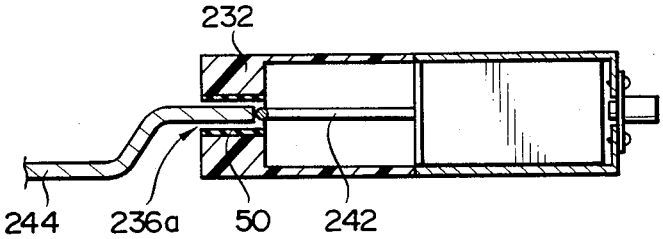
FIGS. 5 and 6 are cross-sectional views respectively showing other forms of a high-frequency pickup according to the present invention.
Figure 6:
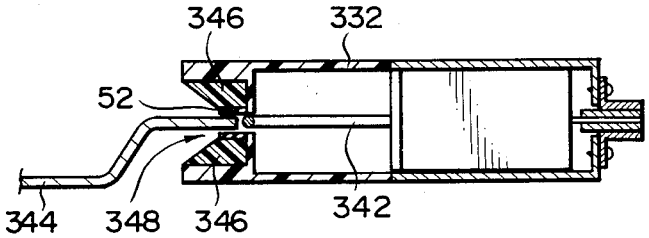

FIGS. 5 and 6 show still other embodiments of a high-frequency pickup according to the present invention. In the embodiment of FIG. 5, parts similar to those of the first embodiment shown in FIGS. 1 and 2 are designated by similar reference numerals added by two hundred. In the embodiment of FIG. 6, parts similar to those of the first embodiment are denoted by similar reference numerals added by three hundred. Such embodiments are characterized by a casing which includes an opening having guiding and positioning elements of a cushion material mounted on the upper and lower walls of the opening to prevent the inner panel member from vibrating in the opening.

More particularly, a casing 232 shown in FIG. 5 includes a first opening 236a which includes cushioning members 50 mounted on the upper and lower walls of the opening 236a. These cushioning members 50 resiliently support the marginal edge of an inner panel member 244. A casing 332 shown in FIG. 6 comprises a first opening which includes similar guide elements 346 defining guide groove means 348. The guide groove means 348 includes cushioning members 52 mounted on the upper and lower walls thereof for resiliently supporting the marginal edge of an inner panel member 344. The cushioning members 50 and 52 may be formed of any suitable resilient material such as rubber plate or the like.

In such arrangements, vibration in the vehicle body can be absorbed by the cushioning members 50 or 52. In the case of FIG. 5, the inner panel member 244 will not interfere with the first opening 236a of the casing 232. In the case of FIG. 6, similarly, the inner panel member 344 will not interfere with the guide groove means 348 defined by the guide elements 346 to generate any abnormal sound. Moreover, each of the loop antennas 242 or 342 can properly and positively be held against the marginal edge of each of the inner panel members 244 or 344 to provide antenna outputs steadily.

If the cushioning members 50 or 52 are made of ferrite rubber containing magnetic particles, a magnetic flux formed by the surface currents on the vehicle body can more efficiently intersect the loop antenna to increase the output of the pickup.

Figure 7:
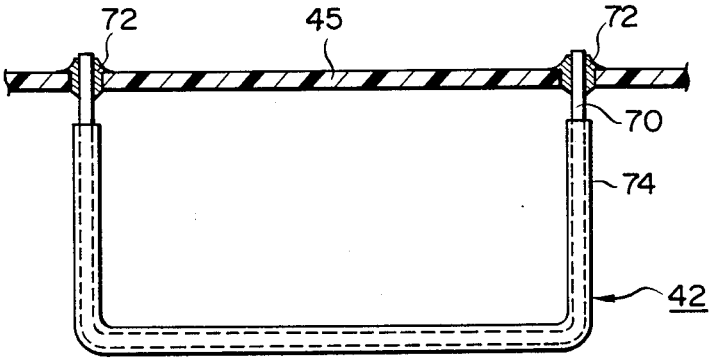
FIG. 7 is a plan view, in an enlarged scale, of a loop antenna which is coated with a suitable insulating material.

FIG. 7 shows a preferred form of a loop antenna used in the present invention. The loop antenna 42 is formed by a length of copper wire 70 having a round or square cross-section. The opposite ends of the copper wire 70 are soldered on a through hole print circuit board 45 defining a matching and amplifying circuit as shown at 72. The portion of the copper wire 70 other than the soldered ends 72 is covered with an insulation 74 which is made of any suitable dielectric material such as enamel, polyvinyl chloride, Teflon, polyethylene, polyester or the like. The dielectric material can insulate the loop antenna 42 from the marginal edge of the vehicle body so that the output obtained from the loop antenna 42 can be prevented from being reduced.

Since the output of the pickup 38 is fetched through a resonance circuit comprisng an inductance in the loop antenna 42 and a capacitor provided in the input stage of the circuitry 58, the loop antenna 42 is preferably formed by a good conductor having a reduced internal resistance, such as steel wire, copper wire, aluminium wire or the like. If the loop antenna 42 is formed by a length of aluminium wire, it may be treated by heat to form alumina (A O) as an insulation on the surface of the wire.

The insulation 74 may also include a body of epoxy resin impregnated and cured with a high dielectric material such as ferrite particles and particularly Mn-Zn ferrite particles. Such an insulation 74 electrically separates the loop antenna 42 from the marginal edge of the vehicle body while causing the loop antenna 42 to efficiently detect the surface currents flowing on the marginal edge of the vehicle body. Consequently, the sensitivity of the pickup 38 can be increased.

Figure 8:
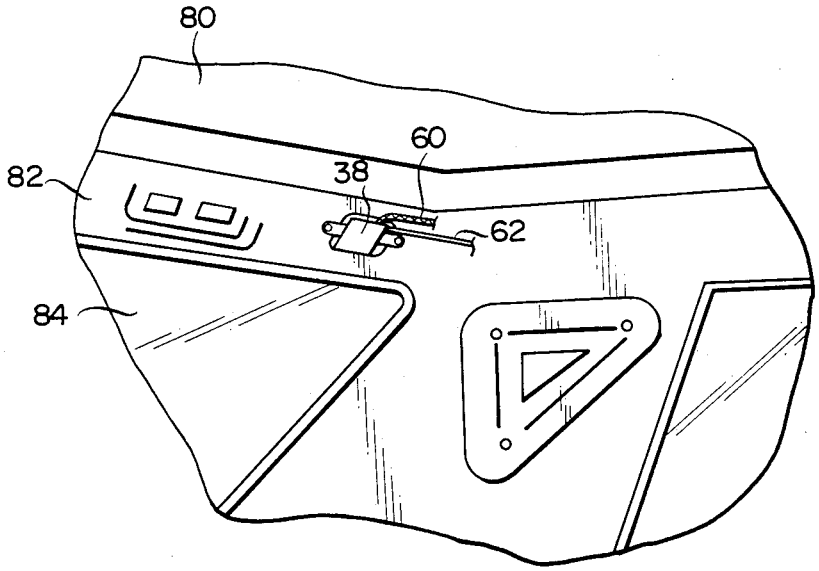
FIG. 8 is a view showing an electromagnetic coupling type high-frequency pickup of an automobile antenna system according to the present invention, which is mounted on the rear window frame in the roof panel of the vehicle body.
Figure 9:
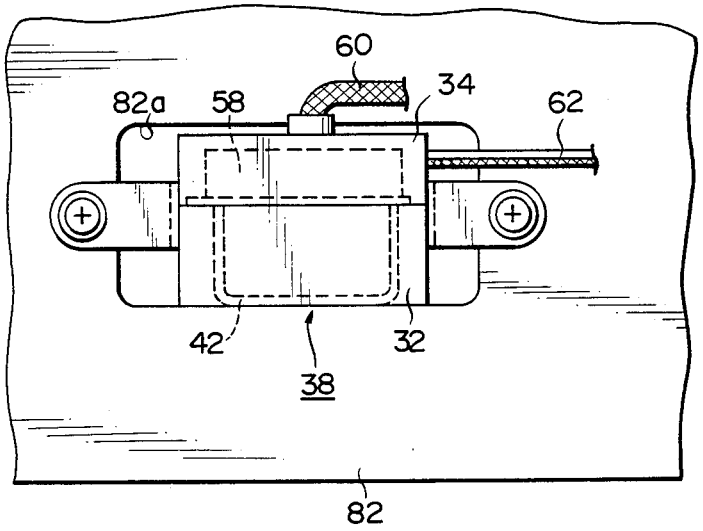
FIG. 9 is a plan view of the high-frequency pickup shown in FIG. 8.

FIGS. 8 and 9 illustrate the aforementioned high-frequency pickup 38 mounted on the vehicle body near the marginal edge of the rearward roof portion 80 thereof.

Referring to FIG. 8, there is shown the roof panel portion 80 of a metallic material uncovered, which includes a rear window frame 82 located at the marginal edge portion thereof and connected with a rear window glass 84. In the present embodiment, the high-frequency pickup 38 is spaced from the marginal edge of the rear window frame 82 within a range of 4.5 cm.

As seen best from FIG. 9, the rear window frame 82 is provided with an opening 82*a* in which the high-frequency pickup 38 comprising the two casings 32 and 34 is located such that the loop antenna 42 therein can be positioned relative to the marginal edge of the rear window frame 82.

In the present embodiment, the exposed side of the loop antenna 42 positioned within the opening of the casing 32 is spaced from the marginal edge of the rear window frame 82 within a distance of 4.5 cm. Thus, the loop antenna 42 can positively receive FM radio waves having a frequency equal to 80 MHz from the surface currents flowing on the marginal edge of the rear window frame 82. Since the surface currents flow on the marginal edge of the rear window frame 82 in the direction parallel thereto as seen from FIG. 15, the longitudinal portion of the loop antenna 42 is disposed parallel to the marginal edge of the rear window frame 82.

Since the loop antenna is coated with the low dielectric insulation 74, the loop antenna 42 can electrically be separated from the marginal edge of the vehicle body. Therefore, the sensitivity of the pickup 38 will not be reduced. When the insulation 74 is made of epoxy resin impregnated with magnetic particles such as ferrite particles, the sensitivity of the pickup 38 can further be improved while maintaining the insulation between the loop antenna 42 and the marginal edge of the vehicle body.

Although the present invention has been described as to the preferred embodiments each utilizing the electromagnetic coupling type high-frequency pickup, it may similarly utilize an electrostatic coupling type high-frequency pickup. In the case of the electrostatic coupling type pickup, a detecting electrode is disposed on a vehicle portion through an air gap or insulating plate and extends parallel to the marginal edge of that vehicle portion. The detecting electrode functions to detect surface high-frequency currents from the vehicle portion through an electrostatic capacity formed between the marginal edge of the vehicle portion and the detecting electrode.

As will readily be apparent from the foregoing, the present invention provides an automobile antenna system for receiving radio waves or waves belonging to relatively high frequency bands, for example FM or higher frequency bands, from surface high-frequency currents flowing on a particular location and in particular a marginal edge portion on the vehicle body. Therefore, radio or other waves can more efficiently be received by the antenna system with less noise. Furthermore, the pickup can readily be mounted such that the loop antenna therein will properly be positioned relative to the marginal edge of the vehicle body. Moreover, since the loop antenna positioned relative to the marginal edge of the vehicle body is covered with insulation, radio or other waves can more efficiently be detected with less noise while at the same time the sensitivity of the pickup can be prevented from being reduced.

We claim:

1. An automobile antenna system for use on a vehicle body, said system comprising:

high-frequency pickup means for detecting high-frequency surface currents induced on the vehicle body, by broadcast waves, and concentrated on a marginal edge portion of the vehicle body, the marginal edge portion being a peripheral edge portion of a metal plate which forms the vehicle body, said high-frequency pickup means comprising a loop antenna and circuit means for processing a signal detected by the loop antenna; and casing means for housing the high-frequency pickup means and having an opening for guiding and positioning the marginal edge portion of the vehicle body partially into said casing, the loop antenna of said high-frequency pickup means extending along an interior side of the opening of said casing so as to be disposed in parallel to, opposed to and in close proximity to the marginal edge portion of the vehicle body.

2. An automobile antenna system as defined in claim 1 wherein said casing means includes guide means removably mounted on the upper and lower walls of the opening to define guide groove means therebetween, said guide groove means being adapted to properly position said casing relative to the marginal edge portion of the vehicle body.

3. An automobile antenna system as defined in any one of claim 1 or 2 wherein the opening of said casing includes cushioning means for resiliently supporting the marginal edge portion of the vehicle body when the marginal edge portion of the vehicle body is positioned in the opening.

4. An automobile antenna system as defined in claim 1 wherein said loop antenna positioned relative to the marginal edge portion of the vehicle body is substantially covered with insulation, so that the loop antenna is insulated from the marginal edge portion of the vehicle body.

5. An automobile antenna system as defined in claim 4 wherein said insulation is formed of a dielectric material having a small dielectric constant value.

6. An automobile antenna system as defined in claim 4 wherein said insulation contains ferrite particles impregnated therein.

* * * * *